United States Patent [19]

Ogawa et al.

[11] 4,247,196

[45] Jan. 27, 1981

[54] CLEANING DEVICE FOR USE IN ELECTROPHOTOGRAPHIC COPYING MACHINES

[75] Inventors: Masaya Ogawa, Osaka; Takashi Sugiyama, Sakai; Hiroshi Mizuno, Ikoma, all of Japan

[73] Assignee: Minolta Camera Kabushiki Kaisha, Osaka, Japan

[21] Appl. No.: 28,307

[22] Filed: Apr. 9, 1979

[30] Foreign Application Priority Data

Apr. 26, 1978 [JP] Japan ..... 53-50602
Apr. 27, 1978 [JP] Japan ..... 53-51428

[51] Int. Cl.[3] ..... G03G 21/00
[52] U.S. Cl. ..... 355/15; 15/256.51
[58] Field of Search ..... 355/15; 118/652; 15/256.5, 256.51

[56] References Cited

U.S. PATENT DOCUMENTS

| | | | |
|---|---|---|---|
| 3,552,850 | 1/1971 | Royka et al. | 355/15 |
| 3,848,993 | 11/1974 | Hasiotis | 355/15 |
| 3,859,691 | 6/1980 | Katayama et al. | 15/256.51 |
| 4,152,067 | 5/1979 | Kubota | 355/15 |

*Primary Examiner*—R. L. Moses

*Attorney, Agent, or Firm*—Wolder, Gross & Yavner

[57] ABSTRACT

The invention is directed to a device for cleaning the surface of a rotatably mounted photosensitive member in an electrophotographic copying machine and includes an elastic blade carried in a holder so as to be positioned in pressing engagement with the surface of the photosensitive member for removing residual developer from the photosensitive member surface. The blade is held at an angle between a surface of the photosensitive member and a side of the blade which faces opposite to the direction of rotation of the member which is either a right angle or an acute angle which is close to a right angle. Biasing means act either on the holder or on the blade in order to urge the blade toward the surface of the photosensitive member so that its forward end is in pressing contact therewith. The holder of the blade has a front wall for supporting the top surface of the blade which faces toward the direction of rotation of the photosensitive member. The top wall extends to a position close to the forward end of the blade. Elastic strain resulting from frictional forces and normal reaction forces developed between the surface of the photosensitive member and the forward end of the blade are thereby absorbed in the blade.

20 Claims, 12 Drawing Figures

CLEANING DEVICE FOR USE IN ELECTROPHOTOGRAPHIC COPYING MACHINES

BACKGROUND OF THE INVENTION

The present invention relates generally to electrophographic copying machines and more particularly to a device for cleaning the photosensitive members of such machines.

In electrophotographic copying machines of the toner image transfer type, the surface of the photosensitive member must be cleaned to remove the toner which remains thereon after a toner image formed on the surface has been transferred to copy paper. Devices for cleaning the photosensitive surface, are known. One such known device includes an elastic blade adapted to be held in pressing contact with the surface of the photosensitive member to wipe the surface clean. U.S. Pat. No. 3,859,691, for example, discloses a device of this type which, as shown in FIG. 1 of the accompanying drawings, which will be described more fully hereinafter, includes an elastic blade B supported at its upper base portion by a holder A and held in pressing contact with the surface of a photosensitive member D which rotates in the direction of arrow C. The blade B is inclined at an obtuse angle $\theta_1$ with that surface of the member D which is located on the side of the blade facing opposite to the direction of rotation of member D so that end portion b will clean member D. Since the blade B is adapted to be placed into the holder A while its open end a is facing down, the blade B must be inserted into the holder A with care to prevent the blade from falling. Holder A must also be designed to firmly retain the blade B in order to prevent the blade B from slipping out of the holder A while it is being brought into position for contact with the surface of the photosensitive member D. This known device also has the disadvantage that during the rotation of the photosensitive member D and while the blade B is cleaning the photosensitive surface, the blade end portion b has a tendency to curl up toward the direction of rotation of the photosensitive member D as a result of frictional contact with the surface of the member D, thus failing to perform the desired cleaning operation.

FIG. 2 of the accompanying drawings shows another blade B which extends upward while being supported by a holder A. This general arrangement is more fully disclosed in U.S. Pat. No. 3,552,850. In this arrangement the bottom surface of blade B (facing opposite the direction of rotation of member D) is held in pressing contact with the surface of a photosensitive member D and is inclined at an acute angle $\theta_2$ with the surface of the member D located on that side of the blade facing opposite to the direction of rotation of member D. Although the blade of this type is not likely to fall, the frictional force F between the forward end portion b of the blade B and the photosensitive member D acts to draw the blade B out of the holder A while the blade cleans the surface of the member D. Thus the holder A, like the one shown in FIG. 1, must be designed to fully and rigidly hold the blade B to prevent it from coming out. Additionally, the resultant force R of the normal reaction N exerted on the blade B by the surface of the photosensitive member D and the frictional force F between the blade B and the member D acts to move the blade end portion b away from the photosensitive surface, thus reducing the pressing force of the blade B on the photosensitive member D. Consequently, the blade B might leave residual toner partially unremoved because of its reduced cleaning ability.

The blade B shown in FIG. 3 of the accompanying drawings appears useful for overcoming the disadvantages of the conventional devices described above. This blade B is held in pressing contact with the surface of a photosensitive member D and is positioned laterally at an angle $\theta_3$ with the surface of the member D located on that side of the blade facing opposite to the direction of rotation of the photosensitive member D. The angle $\theta_3$ is almost as large as a right angle. This arrangement is free of the drawback of the device shown in FIG. 1 that the blade B, when extending downward, is likely to fall or to be curled up by frictional contact with the photosensitive surface. The arrangement of FIG. 3 has also overcome the drawback of the device of FIG. 2 that the blade B might be drawn out of the holder by frictional contact with the photosensitive surface or the blade B is unable to fully remove the residual toner because the blade bears on the photosensitive surface under reduced pressure with a lower frictional force acting between the blade and the photosensitive member D.

However, since the angle $\theta_3$ is approximate to a right angle, the blade B is almost unable to elastically contact the photosensitive member D and acts thereon as if it were a non-elastic body. As a result, the contact effected between the blade B and the photosensitive member D is not as intimate as required to overcome the minute projections on the opposed contact surfaces such as illustrated in FIG. 4. When the photosensitive member D axially deflects as shown in FIG. 5, or when the contact face of the blade B deflects as shown in FIG. 6, as a result of an error involved in mounting or shaping the blade B, the blade will be unable to intimately contact the photosensitive surface across its full length by absorbing the deflection with its flexibility. In either case therefore, the blade B will not evenly contact the photosensitive member D and a gap G will be formed therebetween as shown in FIGS. 4 to 6. The surface of the photosensitive member will therefore not be effectively cleaned.

This defect can be eliminated solely by pressing the blade B against the photosensitive member D in the direction of arrow E with an increased force. The frictional force between the blade B and the member D will then increase in proportion to the increase of the pressing force, necessitating a greater torque for the rotation of the member D and causing rapid wear or damage to the photosensitive surface or to the contact end portion b of the blade B.

SUMMARY OF THE INVENTION

An object of the present invention is to provide a device for cleaning the photosensitive members of electrophotographic copying machines which overcomes the disadvantages of the prior art cleaning devices of the wiping blade type.

Another object of the invention is to provide a device for cleaning the photosensitive members of electrophotographic copying machines which includes an elastic blade positioned either at a right angle or at an acute angle close to a right angle with respect to the surface of the photosensitive member which is located on that side of the blade facing opposite to the direction of rotation of the member, the blade being pressed into uniform contact with the photosensitive surface by a relatively small force and thereby adapted to clean the surface efficiently free of problems.

In order to achieve the foregoing objectives, the present invention provides a device for cleaning the photosensitive member of an electrophotographic copying machine comprising an elastic blade retained by a holder either at a right angle or at an acute angle which is close to a right angle with respect to the surface of the photosensitive member located on that side of the blade facing opposite to the direction of rotation of the member, the blade having its forward end held in contact with the surface of the photosensitive member to remove residual developer from the photosensitive surface by means pressing against the rearward end of the blade, the device being characterized in that:

(i) the top surface of the blade facing toward the direction of rotation of the photosensitive member is supported by a front wall extension of the holder extending almost to the forward end of the blade, and (ii) the blade has a groove extending substantially in parallel to its forward end and formed in the forward end portion of the blade on its bottom surface which faces opposite to the direction of rotation of the photosensitive member, or is slidably supported by the holder being pressed against the surface of the photosensitive member from its rearward end.

BRIEF DESCRIPTION OF THE DRAWINGS

Embodiments of the present invention will be more specifically described with reference to the accompanying drawings, in which.

DESCRIPTION OF THE PREFERRED EMBODIMENTS

Figure 7:
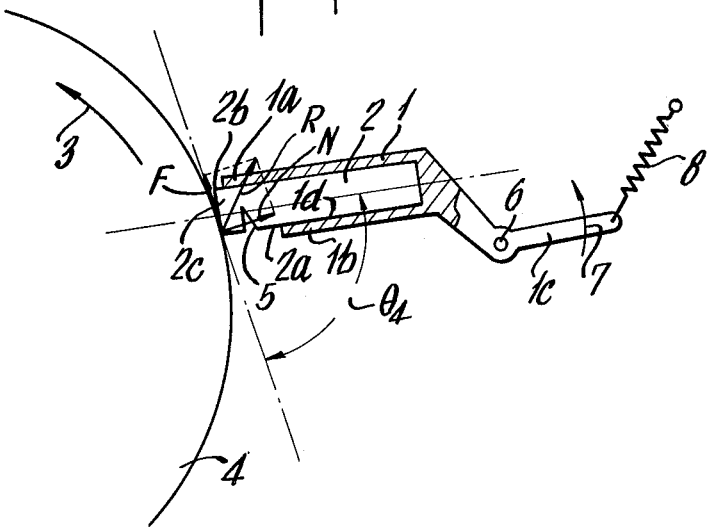
FIG. 7 is a side elevational view showing one embodiment of the present invention.

Referring now in more detail to the accompanying drawings, a first embodiment of the present invention for cleaning a photosensitive member will be described with reference to FIGS. 7 to 9. In this embodiment, an elastic blade 2 is supported in a holder 1. The blade 2 is held in a lateral position and is urged into pressing contact with the surface of a photosensitive member 4 which is rotatable in the direction of arrow 3. As can be seen in FIG. 7, blade 2 forms an acute angle $\theta_4$ with the surface of the photosensitive member that is located on that side of the blade facing opposite to the direction of rotation of the member 4. Angle $\theta_4$ is approximately a right angle. Bottom surface 2*a* of blade 2 is on that side of the blade which is opposite to the direction of rotation of the member 4. Blade 2 has a groove 5 formed in the bottom surface 2*a* extending along its entire length and substantially in parallel to its forward end. Groove 5 is positioned close to the end 2*c* of blade 2. The top surface 2*b* of the blade 2, which faces in the direction of rotation of the photosensitive member 4, is supported by a front wall extension 1*a* of the holder 1. This extension 1*a* extends almost to the forward end 2*c* of the blade. The groove 5 is formed in a portion of bottom surface 2*a* which is exposed from the rear wall 1*b* of the holder.

The holder 1 is pivotably supported by a pin 6 and has a lever 1*c* extending rearward from the supported portion. Lever 1*c* is biased by a spring 8 in the direction of arrow 7 to urge the forward end portion 2*c* of the blade 2 against the surface of the member 4. The edge which is formed by the end portion 2*c* of the blade 2 meeting the bottom surface 2*a*, where the angle $\theta_4$ is formed, cleans the surface of the member 4 as it rotates in the direction of arrow 3. Any means other than the spring 8 may be used for biasing the holder 1 to urge the blade 2 into pressing contact with the photosensitive surface.

Figure 4:
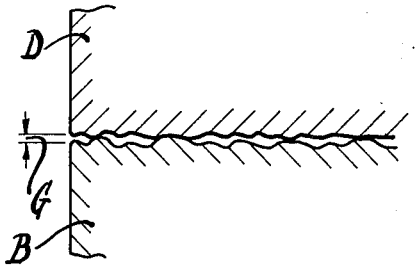
FIGS. 4 to 6 are sectional views each showing a gap formed between a blade and the surface of a photosensitive member in contact therewith under varying conditions.

With the construction described above, the angle $\theta_4$ is acute, and the top surface 2*b* of the blade 2 is supported by the front wall extension 1*a* of the holder 1 extending to a position close to the forward end of the blade, so that even when a frictional force F acts between the forward end portion 2*c* of the blade and the member 4 as shown in FIG. 7, the rotation of the member 4 will not cause the forward end portion 2*c* to curl up. With the acute angle $\theta_4$ formed between the blade 2 and the photosensitive surface, the blade forward end portion 2*c* is subjected to the resultant force R of the frictional force F and the normal reaction force N on the end portion 2*c*. The resultant force R presses the blade end portion 2*c* against the holder extension 1*a* as illustrated and is absorbed by the extension 1*a*. Thus the resultant force R acts to compress the blade 2. This force R is therefore accommodated in the blade as elastic strain to produce a cleaning force on the photosensitive member 4. Moreover, the elastic strain created by the resultant force R and the elastic strain resulting from the pressing contact of the blade end portion 2*c* with the photosensitive surface caused by the holder 1 are absorbed by the groove 5 which permits the blade end portion 2*c* to sufficiently flex by virtue of the elasticity of the blade 2 itself. Consequently, a relatively small pressing force applied to the blade 2 will eliminate the gap G shown in FIGS. 4 to 6, so that the blade 2 will remain in uniform contact with the photosensitive surface to entirely clean the surface.

Figure 8:
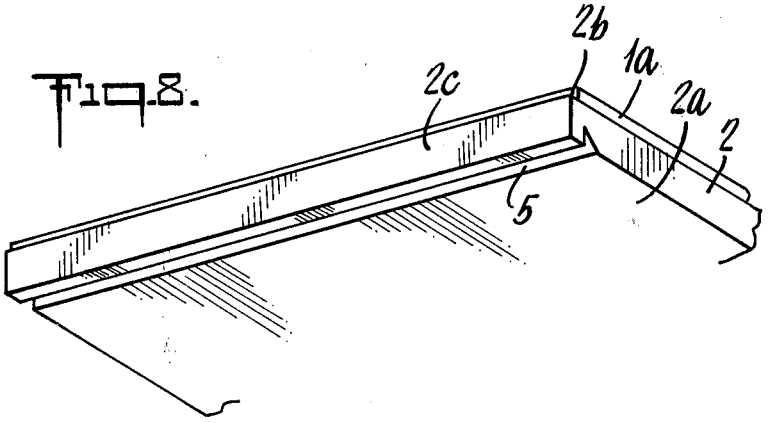
FIG. 8 is a perspective view showing the blade of the embodiment illustrated in FIG. 7.

FIG. 8 is a perspective view showing the blade 2 formed with the groove 5. FIG. 9 shows the shape of the blade end portion 2*c* including the groove 5 which has been found useful for achieving an outstanding cleaning effect. With reference to FIG. 9, t is the thickness of the blade 2, h is the depth of the groove 5, a is the length of the blade 2 from its forward end to the groove 5, and c is the effective length of the blade 2 (i.e. the length of the blade from its forward end to the forward end of the holder wall extension 1*a*). The best results are achievable when $a<t$, and $0 \leqq c < a$. Experiments have shown that good results are obtained when the blade has a hardness of 65 to 75 deg, $t=3$ to 7 mm, $c=0$ to 5 mm, $a=2$ to 5 mm, $h=2$ to 6 mm and $\pi/3 \leqq \theta_4 < \pi/2$, for example, with use of a polyurethane rubber blade which has a hardness of 65 deg and an angle $\theta_4$ of 84° and in which $a=3$ mm, $h=3$ mm and $c=0$ mm.

Figure 9:
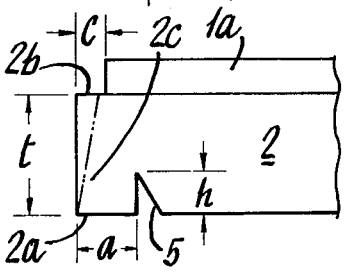
FIG. 9 is an enlarged side elevational view showing the front end portion of the blade illustrated in FIG. 8.

Although the blade 2 described above has a right-angled edge at its forward end and is disposed at an acute angle $\theta_4$, the edge of the forward end may have an acute angle as shown in a phantom line in FIG. 9. In this case even when the blade 2 is positioned at an angle $\theta_4$ of 90°, the portion of the blade end closer to the bottom surface 2*a* thereof formed with the groove 5 comes into pressing contact with the photosensitive surface for cleaning. As a result, the groove 5 permits the blade end portion 2*c* to satisfactory flex as already described. Thus the angle $\theta_4$ can be set at 90° depending on the shape of the edge at the forward end portion 2*c*. The blade 2 can be made from silicone rubber, synthetic resin or natural elastic material provided that the material has the hardness specified above and the desired cleaning ability.

The blade 2 can be inserted into or removed from the holder 1 for replacement when the holder 1 is pivoted clockwise in FIG. 7 by the lever 1*c* against the action of the spring 8 or is released from the spring to direct the holder inlet 1*d* upward.

According to the embodiment described above, the blade is easily mountable in the holder or demountable therefrom for replacement. Moreover the holder extending almost to the forward end of the blade to support its top surface 2*b* and the groove formed on the bottom surface of the blade coact to enable a relatively small force to hold the blade in uniform pressing contact with the surface of the photosensitive member, thus permitting the blade to perform the desired cleaning operation. Since the blade will not be subjected to any action that would separate the blade from the surface of the photosensitive member, the blade end portion can be properly maintained in contact with the surface. This assures that the blade will clean the photosensitive surface with high stability without leaving any toner on the surface.

Further embodiments of the invention will now be described in connection with FIGS. 10–12.

Figure 10:
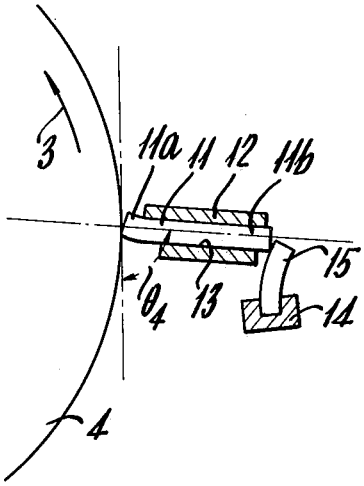
FIG. 10 is a side elevational view in section showing another embodiment of the present invention.

FIG. 10 shows one embodiment comprising a blade 11 of elastic material slidably supported between two guide plates 12 and 13 positioned one above the other. The guide plates are attached to a frame, not shown. The blade 11 has a forward end 11*a* held in contact with the surface of a photosensitive member 4 which is rotatable in the direction of arrow 3. The blade 11 is positioned either at a right angle or at an acute angle $\theta_4$ which is close to a right angle with that surface of the member 4 which is located on that side of blade 11 facing opposite to the direction of rotation of member 4. A sufficiently flexed second blade 15 bears against the tail end 11*b* of the blade 11. The second blade 15 is supported by a holder 14 and is preferably made of the same elastic material as the blade 11.

Figure 1:
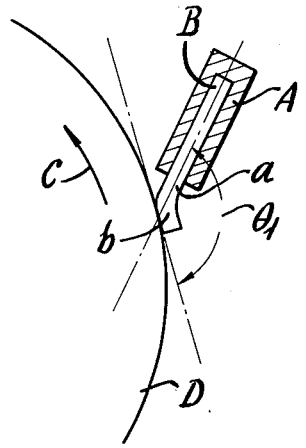
FIGS. 1 to 3 are side elevational views in section each showing a different conventional device.
Figure 2:
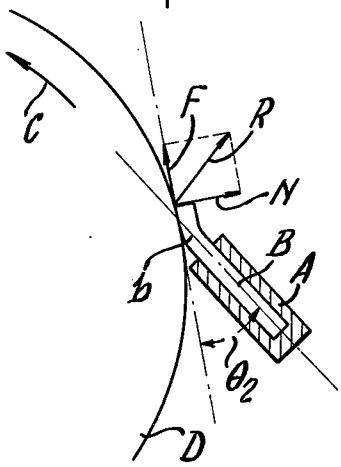
Figure 3:
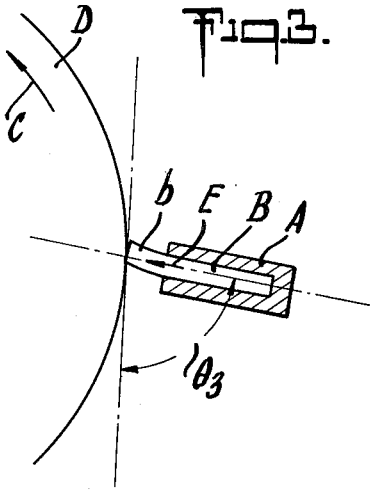

Since the second blade presses against the tail of blade 11 and because blade 11 is slidably carried between the guide plates 12 and 13, the blade end 11*a* will be held in pressing contact with the photosensitive member 4 to remove toner from the surface of the member 4. With the blade 11 positioned at a right angle or an acute angle $\theta_4$ with the surface of the member 4, the blade 11 will not curl up by the rotation of the photosensitive member 4 unlike the blade shown in FIG. 1.

Figure 5:
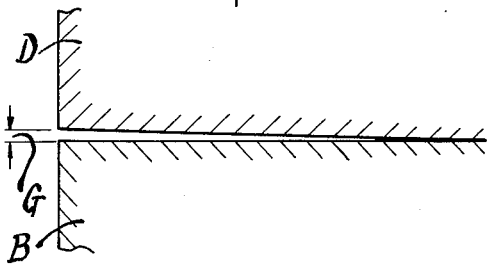
Figure 6:
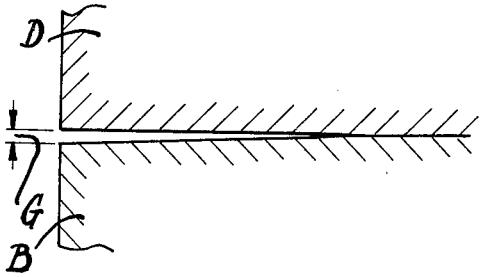

The photosensitive member and/or blade may deflect to produce a gap therebetween as shown in FIGS. 5 and 6 when the angle between the photosensitive surface and the blade is large, whereas the blade 11 which is pressed toward the photosensitive member by the second blade 15 and slidably supported by the guide plates 12 and 13 will then shift to eliminate the gap. Consequently, the blade end 11*a* will be uniformly held in pressing contact with and axially along the surface of the member 4 to uniformly clean the surface of photosensitive member 4.

The large angle provided between the surface of the member 4 and the blade enables the blade to perform as uniform a cleaning operation as when the angle is smaller while affording an enhanced cleaning ability.

Figure 11:
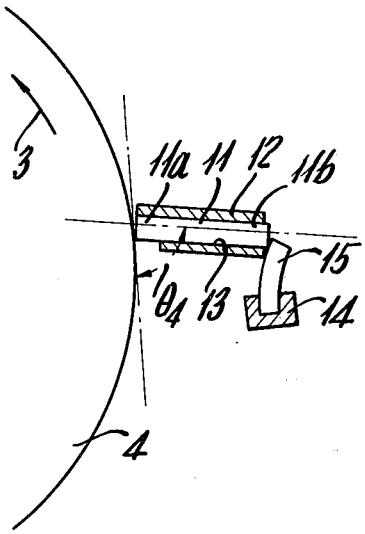
FIGS. 11 and 12 are sectional views each showing a different modification of the embodiment of FIG. 10.

Referring now to FIG. 11, a modification of the embodiment of FIG. 10 is shown. In this modification, the forward end of the guide plate 12, which is in contact with the top surface of the blade 11, is positioned closer to the photosensitive member 4 than the blade end 11*a*. This renders the blade end 11*a* less flexible in the direction of rotation of the member 4 than in the arrangement of FIG. 10 to thus preclude the reduction of cleaning efficiency that would result from such flexure.

A plate spring may also be used as the second blade 15 if it is capable of uniformly biasing the blade 11 toward the photosensitive member.

Figure 12:
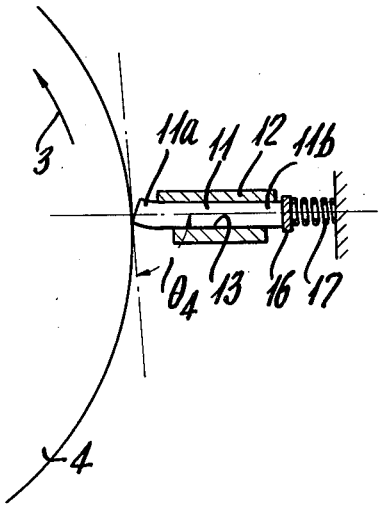

FIG. 12 shows another modification of this embodiment in which the second blade 15 shown in FIG. 10 for pressing the blade 11 against the photosensitive member 4 is replaced by a steel plate 16 and a spring 17. The steel plate 16 serves to permit the blade end 11*a* to bear against the surface of the photosensitive member 4 uniformly axially along the member 4.

In the second embodiment of the invention described above, the blade holder serves as a guide means for slidably supporting the blade and therefore renders the blade easily mountable in the holder or removable therefrom for replacement, as in the first embodiment. Since the biasing means presses against the tail end of the slidable blade, a relatively small pressing force enables the blade to retain a uniform cleaning action while eliminating the improper operation that otherwise would result, for example, from the deflection of the photosensitive member or blade.

Further, according to the modification in which the guide means on the top surface of the blade is positioned closer to the photosensitive member than the forward end of the blade, the blade end is made less flexible in the direction of rotation of the photosensitive member to provide an increased angle between the blade and the photosensitive surface located on that side of the blade facing opposite to the direction of rotation of the photosensitive member to thereby achieve an improved cleaning efficiency.

While the present invention has been described and illustrated with respect to certain preferred embodiments which produce satisfactory results, it will be appreciated by those skilled in the art, after understanding the purposes of the invention, that various changes and modifications may be made without departing from the spirit and scope of the invention, and it is therefore intended to cover all such changes and modifications in the appended claims.

What is claimed is:

1. A device for cleaning the surface of a photosensitive member in an electrophotographic copying machine comprising:

an elastic blade for removing residual developer from the surface of the photosensitive member, said blade having a cleaning side and a noncleaning side;

a holder for retaining said blade in a lateral position either at a right angle or at an acute angle close to a right angle with respect to the surface of the photosensitive member, said angle being formed between said surface of the photosensitive member and a side of said blade facing toward said cleaning side thereof; and biasing means for urging the forward end portion of said blade into pressing contact with the surface of the photosensitive member;

said holder having a front wall for supporting the surface of said blade facing the noncleaning side thereof, said noncleaning side facing toward the direction of rotation of the photosensitive member, said front wall of said holder extending to a position close to the forward end of said blade;

whereby the forward end portion of said blade is positioned so as to absorb the elastic strain created by the resultant of a frictional force and a normal reaction force on the end portion, and to absorb the elastic strain resulting from the pressing contact of the end portion with the photosensitive surface.

2. The device as claimed in claim 1, wherein said holder is pivotably supported by a pin, and wherein said biasing means comprises a spring acting on said holder to urge said blade into pressing contact with the photosensitive surface, said device further comprising a groove extending substantially in parallel to the forward end of said blade and positioned close to the end of said blade, said groove being located on the cleaning side surface of the blade, said cleaning side surface facing opposite to the direction of rotation of the photosensitive member.

3. The device as claimed in claim 2, wherein said groove is formed in the cleaning side surface of said blade at a portion thereof which is exposed from the rear wall of said holder.

4. The device as claimed in claim 3, wherein said blade is formed so that: $a<t$, and $0 \leqq c<a$, when t is the thickness of said blade, a is the length of said blade from its forward end to said groove, and c is the length of said blade from its forward end to the forward end of the holder front wall extension.

5. The device as claimed in claim 1, wherein said holder serves as guide means for slidably supporting said blade, said holder being attached to a frame of the device, said biasing means bearing against the tail end of said blade.

6. The device as claimed in claim 5, wherein said biasing means comprises a sufficiently flexed plate supported by a holder.

7. The device as claimed in claim 6, wherein said plate is made of the same elastic material as said elastic blade.

8. The device as claimed in claim 6, wherein said plate is made of steel.

9. The device as claimed in claim 5, wherein said biasing means comprises a steel plate and a spring.

10. A device for cleaning the surface of rotatably mounted photosensitive member in an electrophotographic copying machine comprising a blade holder, an elastic blade having a noncleaning side surface, a cleaning side surface, a forward end and a rearward end carried in said blade holder so that its forward end engages the surface of said photosensitive member for removing developer particles from the surface thereof, said blade being held by said blade holder at an angle formed between said photosensitive member surface and the cleaning side surface of said blade which faces opposite to the direction of rotation of said photosensitive member, biasing means for urging the forward end of said blade into pressing contact with the surface of said photosensitive member, and a front wall of said holder for supporting the noncleaning side surface of said blade which faces toward the direction of rotation of said photosensitive member extending to a position close to the forward end of said blade, whereby elastic strain resulting from frictional force and normal reaction force developed between the forward end of said blade and the photosensitive member is absorbed by said blade, said angle formed between the surface of said photosensitive member and the cleaning side of said blade facing opposite to the direction of rotation of said member is a right angle.

11. The device as claimed in claim 10 wherein said angle formed between said surface of the photosensitive member and the cleaning side of said blade facing opposite to the direction of rotation of said member is an acute angle close to a right angle.

12. The device as claimed in claim 10 wherein said holder is pivotally mounted for movement toward and away from said photosensitive member, and wherein said biasing means comprises a spring for urging said holder toward said photosensitive member so that said blade will be pressed against the surface of said photosensitive member.

13. A device for cleaning the surface of a rotatably mounted photosensitive member in an electrophotographic copying machine comprising a blade holder, an elastic blade having a noncleaning side surface, a cleaning side surface, a forward end and a rearward end carried in said blade holder so that its forward end engages the surface of said photosensitive member for removing developer particles from the surface thereof, said blade being held by said blade holder at an angle formed between said photosensitive member surface and the cleaning side surface of said blade which faces opposite to the direction of rotation of said photosensitive member, biasing means for urging the forward end of said blade into pressing contact with the surface of said photosensitive member, and a front wall of said holder for supporting the noncleaning side surface of said blade which faces toward the direction of rotation of said photosensitive member extending to a position close to the forward end of said blade, whereby elastic strain resulting from frictional force and normal reaction force developed between the forward end of said blade and the photosensitive member is absorbed by said blade, a groove formed on the cleaning side surface of said blade located adjacent the forward end of said blade and axially extending the length of said blade in a direction parallel to the forward end thereof.

14. The device as claimed in claim 13 wherein said elastic strain developed in said blade is absorbed by said groove.

15. The device as claimed in claim 14 wherein said groove is exposed from the rear wall of said holder.

16. The device as claimed in claim 15 wherein the thickness of the blade is greater than the length of said blade from its forward end to said groove, and wherein the length of the blade extending from the forward end thereof to the forward most end of the holder front wall extension is less than the length of the blade from its forward end to said groove.

17. A device for cleaning the surface of a rotatably mounted photosensitive member in an electrophotographic copying machine comprising a blade holder, an elastic blade having a noncleaning side surface, a cleaning side surface, a forward end and a rearward end carried in said blade holder so that its forward end engages the surface of said photosensitive member for removing developer particles from the surface thereof, said blade being held by said blade holder at an angle formed between said photosensitive member surface and the cleaning side surface of said blade which faces opposite to the direction of rotation of said photosensitive member, biasing means for urging the forward end of said blade into pressing contact with the surface of said photosensitive member, and a front wall of said holder for supporting the noncleaning side surface of said blade which faces toward the direction of rotation of said photosensitive member extending to a position close to the forward end of said blade, whereby elastic strain resulting from frictional force and normal reaction force developed between the forward end of said blade and the photosensitive member is absorbed by said blade, wherein said blade is slidably supported within said holder for movement toward and away from said photosensitive member.

18. The device as claimed in claim 17 wherein said biasing means acts against the rear end of said blade for urging said blade into pressing contact with the surface of said photosensitive member.

19. The device as claimed in claim 18 wherein said biasing means is a flexed plate supported by a plate holder, said flexed plate acting against the rearward end of said blade.

20. The device as claimed in claim 18 wherein said biasing means comprises a steel plate in contact with the rearward end of said blade and a spring acting thereon for urging said blade into contact with said photosensitive member.

* * * * *